US007914426B1

(12) United States Patent
Lie

(10) Patent No.: US 7,914,426 B1
(45) Date of Patent: Mar. 29, 2011

(54) TWIST EXERCISING DEVICE

(76) Inventor: Wen-Ben Lie, Taichung (TW)

( * ) Notice: Subject to any disclaimer, the term of this patent is extended or adjusted under 35 U.S.C. 154(b) by 1 day.

(21) Appl. No.: 12/642,898

(22) Filed: Dec. 21, 2009

(51) Int. Cl.
*A63B 21/00* (2006.01)

(52) U.S. Cl. ..... 482/126; 482/121

(58) Field of Classification Search ..... 482/127, 482/129, 126, 121
See application file for complete search history.

(56) References Cited

U.S. PATENT DOCUMENTS

| | | | | |
|---|---|---|---|---|
| 1,633,124 | A * | 6/1927 | Noe | 482/126 |
| 3,427,023 | A * | 2/1969 | Silberman | 482/139 |
| 7,090,627 | B1 * | 8/2006 | Walker | 482/140 |

FOREIGN PATENT DOCUMENTS

WO WO 91/08025 * 12/1989

* cited by examiner

*Primary Examiner* — Jerome W Donnelly
(74) *Attorney, Agent, or Firm* — Alan Kamrath; Kamrath & Associates PA

(57) ABSTRACT

A twist exercising device includes two handle units (1) and a plurality of elastic bars (2) detachably mounted between the two handle units. Thus, the number of the elastic bars mounted between the two handle units can be changed freely so as to adjust the tension of the elastic bars according to the user's requirement.

19 Claims, 9 Drawing Sheets

TWIST EXERCISING DEVICE

BACKGROUND OF THE INVENTION

1. Field of the Invention

The present invention relates to an exercising device and, more particularly, to a twist exercising device.

2. Description of the Related Art

A conventional twist bar in accordance with the prior art shown in FIG. 9 comprises a tension spring 10, two support tubes 20 mounted on two opposite ends of the tension spring 10, and two grips 30 mounted on the two support tubes 20 respectively. The tension spring 10 consists of a plurality of elastic rings 12. When in use, after the user's two hands hold the two grips 30, the user can apply a force on the two grips 30 to twist and bend the tension spring 10 so as to achieve an exercising effect to the user's two hands and chest. However, the tension of the tension spring 10 is fixed and cannot be adjusted according to the user's requirement. In addition, when the tension spring 10 is bent and twisted, gaps are produced between the elastic rings 12 of the tension spring 10 so that the user is easily clipped or jammed by the gaps between the elastic rings 12, thereby danger to the user. Further, the tension spring 10, the two support tubes 20 and the two grips 30 are fixed so that the twist bar has a fixed structure and cannot be detached when not in use, thereby causing inconvenience in and decreasing the cost of packaging, storage and transportation of the twist bar.

BRIEF SUMMARY OF THE INVENTION

In accordance with the present invention, there is provided a twist exercising device, comprising two handle units and a plurality of elastic bars detachably mounted between the two handle units. Each of the two handle units includes a housing for mounting the elastic bars and a locking member movably mounted on the housing and releasably locked onto the elastic bars to releasably lock the elastic bars onto the housing. The housing of each of the two handle units has an end face provided with a plurality of slots to allow insertion of the elastic bars. Each of the elastic bars has two opposite ends each provided with a plug insertable into a respective one of the slots of the housing of each of the two handle units and releasably locked by the locking member of each of the two handle units.

According to the primary objective of the present invention, the number of the elastic bars mounted between the two handle units can be changed freely so as to adjust the tension of the elastic bars according to the user's requirement.

According to another objective of the present invention, the elastic bars are mounted on and detached from each of the two handle units easily and quickly, thereby facilitating the user assembling and disassembling the twist exercising device.

According to a further objective of the present invention, the elastic bars are spaced from each other, and each of the elastic bars is an elongate sheet plate so that the elastic bars will not clip or jam the user during operation so as to protect the user's safety.

According to a further objective of the present invention, the elastic bars can be detached from the two handle units when not in use, thereby facilitating and decreasing the cost of packaging, storage and transportation of the twist exercising device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
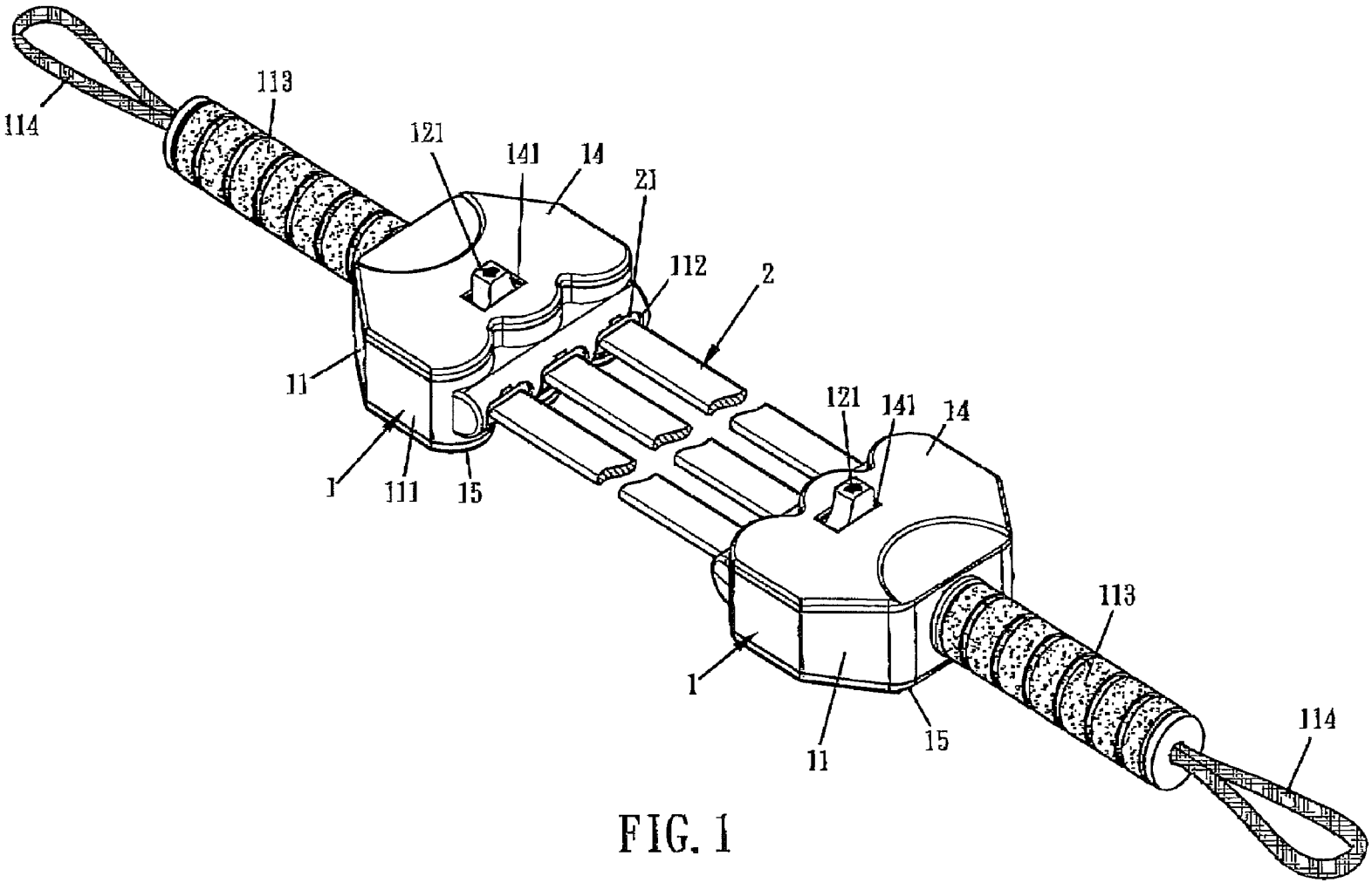
FIG. 1 is a perspective view of a twist exercising device in accordance with the preferred embodiment of the present invention.

Referring to the drawings and initially to FIGS. 1-5, a twist exercising device in accordance with the preferred embodiment of the present invention comprises two handle units 1 and a plurality of elastic bars 2 detachably mounted between the two handle units 1.

Each of the two handle units 1 includes a housing 11 for mounting the elastic bars 2, a locking member 12 movably mounted on the housing 11 and releasably locked onto the elastic bars 2 to releasably lock the elastic bars 2 onto the housing 11, an elastic member 13 mounted in the housing 11 and biased between the housing 11 and the locking member 12, a first cover 14 mounted on the housing 11 to cover the locking member 12, a second cover 15 mounted on the housing 11 and combined with the first cover 14 to sandwich the housing 11 between the first cover 14 and the second cover 15 and to limit the locking member 12 between the first cover 14 and the second cover 15, a resilient grip portion 113 mounted on the housing 11, and a binding loop 114 mounted on the grip portion 113.

The housing 11 of each of the two handle units 1 has an end face provided with a plurality of slots 112 to allow insertion of the elastic bars 2. Each of the slots 112 of the housing 11 of each of the two handle units 1 has a periphery provided with two opposite passages 1121. The housing 11 of each of the two handle units 1 has an inner portion provided with an elongate slideway 115 connected to the slots 112 to allow a sliding movement of the locking member 12. The housing 11 of each of the two handle units 1 has a sidewall 111 provided with a receiving groove 116 connected to the slideway 115 to retain the elastic member 13.

The locking member 12 of each of the two handle units 1 has an elongate shape. The locking member 12 of each of the two handle units 1 is slidably mounted in the slideway 115 and has a first side provided with a plurality of locking blocks 124 to releasably lock the elastic bars 2 and a second side provided with a drive portion 121 protruding outwardly from the housing 11. The locking member 12 of each of the two handle units 1 is provided with a reduced sliding portion 122 slidable in the slideway 115, and each of the locking blocks 124 extends outwardly from the sliding portion 122 and extends into the slideway 115. The locking member 12 of each of the two handle units 1 has an end portion provided with a receiving hole 123 to receive the elastic member 13. Thus, the drive portion 121 of the locking member 12 of each of the two handle units 1 is movable toward the elastic member 13 to compress the elastic member 13 and to move and detach each of the locking blocks 124 of the locking member 12 from the locking groove 211 of the respective plug 21 of each of the elastic bars 2, so that the respective plug 21 of each of the elastic bars 2 is unlockable from the housing 11 of each of the two handle units 1.

The elastic member 13 of each of the two handle units 1 is received in the slideway 115 and has a first end received in the receiving hole 123 of the locking member 12 and a second end received in the receiving groove 116 of the housing 11.

The first cover 14 of each of the two handle units 1 has a surface provided with an exposing slot 141, and the drive portion 121 of the locking member 12 of each of the two handle units 1 protrudes outwardly from and is movable in the exposing slot 141 of the first cover 14.

The elastic bars 2 are spaced from each other. Each of the elastic bars 2 has two opposite ends each provided with a plug 21 insertable into a respective one of the slots 112 of the housing 11 of each of the two handle units 1 and releasably locked by the locking member 12 of each of the two handle units 1. The plug 21 of each of the elastic bars 2 is secured on each of the elastic bars 2 by a rivet 22 which is allowed to pass through the passages 1121 of the respective slot 112 of each of the two handle units 1. The plug 21 of each of the elastic bars 2 has a periphery provided with a locking groove 211 releasably locked onto a respective one of the locking blocks 124 of the locking member 12 of each of the two handle units 1. The plug 21 of each of the elastic bars 2 has an end face provided with a substantially arc-shaped push and guide portion 212 that is movable to abut the respective locking block 124 of the locking member 12 of each of the two handle units 1 when the plug 21 of each of the elastic bars 2 is inserted into the respective slot 112 of the housing 11 of each of the two handle units 1. Thus, the push and guide portion 212 of the plug 21 of each of the elastic bars 2 presses and moves the respective locking block 124 of the locking member 12 of each of the two handle units 1 to compress the elastic member 13 of each of the two handle units 1 as shown in FIG. 5. In addition, the elastic member 13 of each of the two handle units 1 presses and moves each of the locking blocks 124 of the locking member 12 toward the locking groove 211 of the respective plug 21 of each of the elastic bars 2 when each of the locking blocks 124 of the locking member 12 aligns with the locking groove 211 of the respective plug 21 of each of the elastic bars 2 as shown in FIG. 4.

In the preferred embodiment of the present invention, each of the elastic bars 2 is an elongate sheet plate. Alternatively, each of the elastic bars 2 has a substantially rectangular or circular cross-sectional profile.

Figure 2:
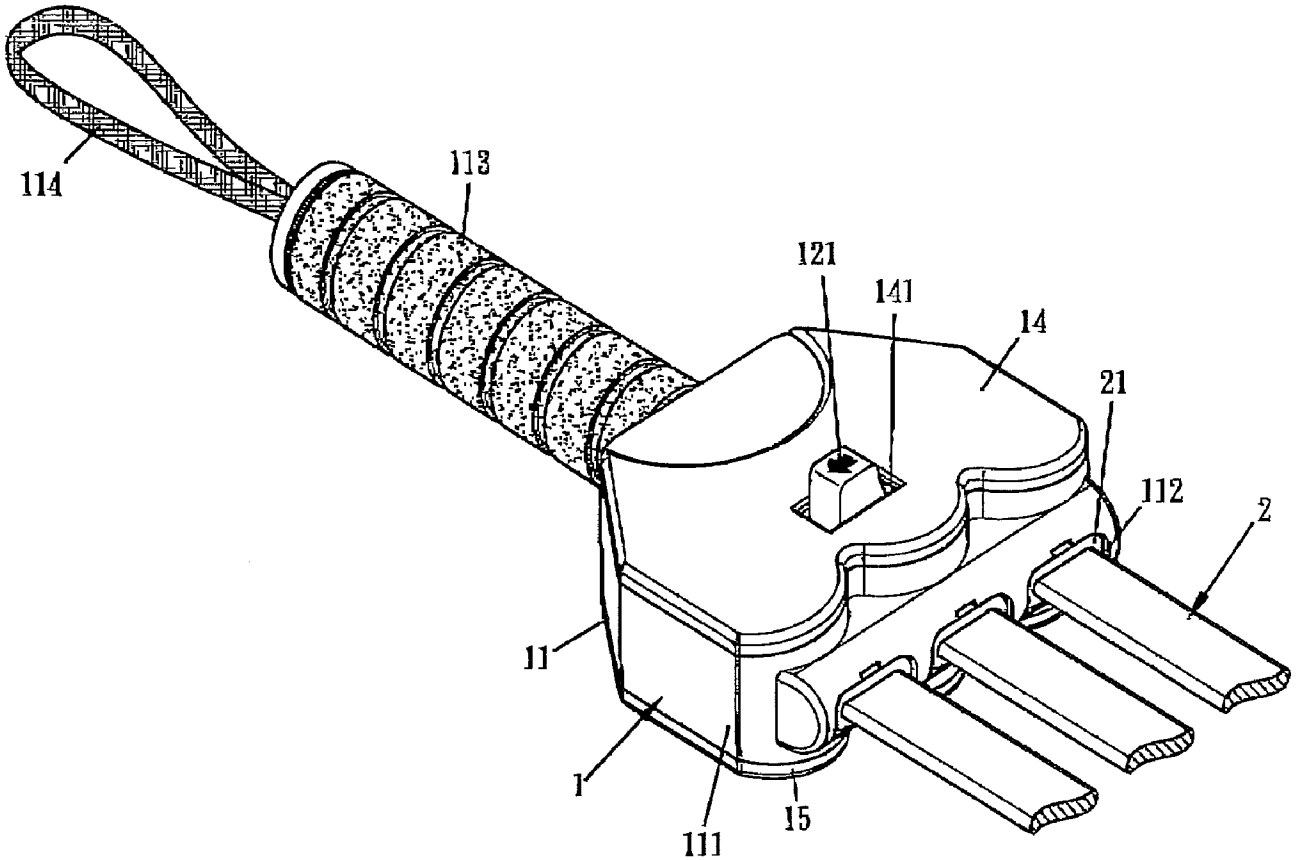
FIG. 2 is a locally enlarged perspective view of the twist exercising device as shown in FIG. 1.
Figure 3:
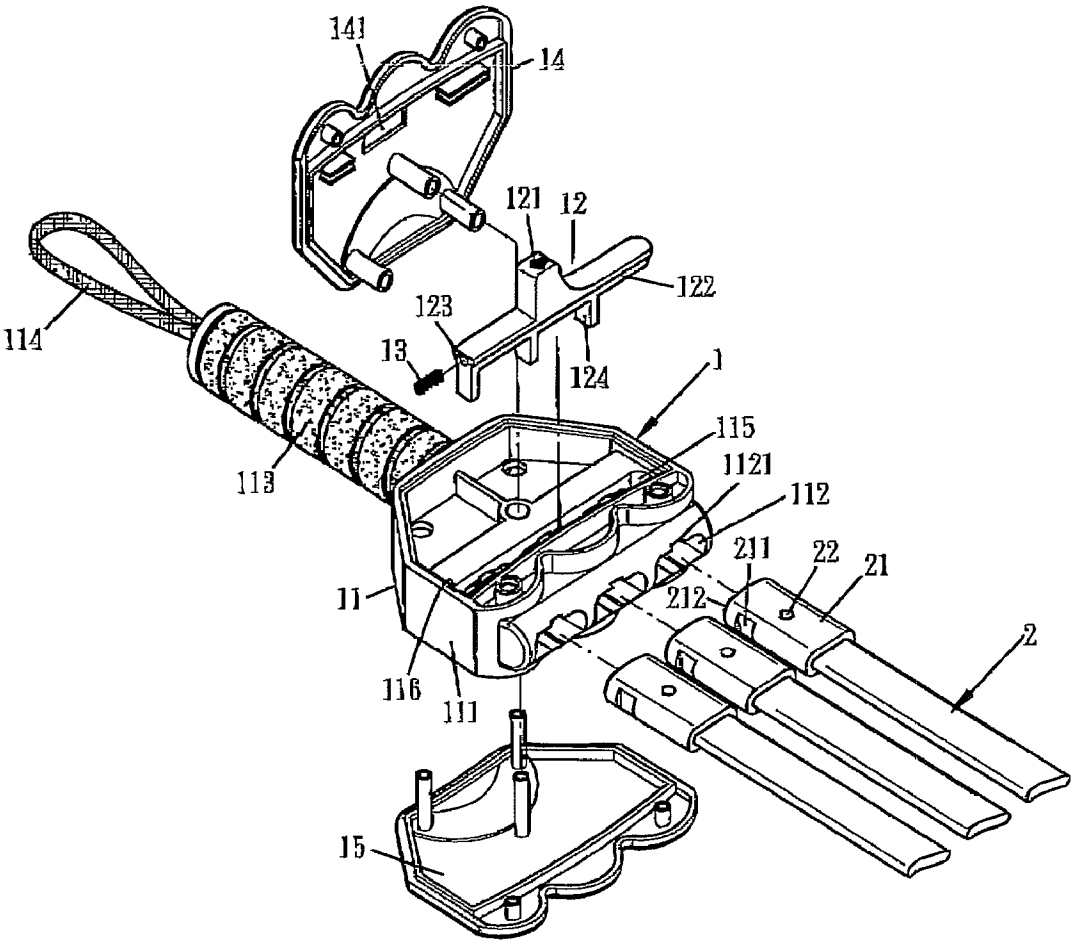
FIG. 3 is an exploded perspective view of the twist exercising device as shown in FIG. 2.
Figure 4:
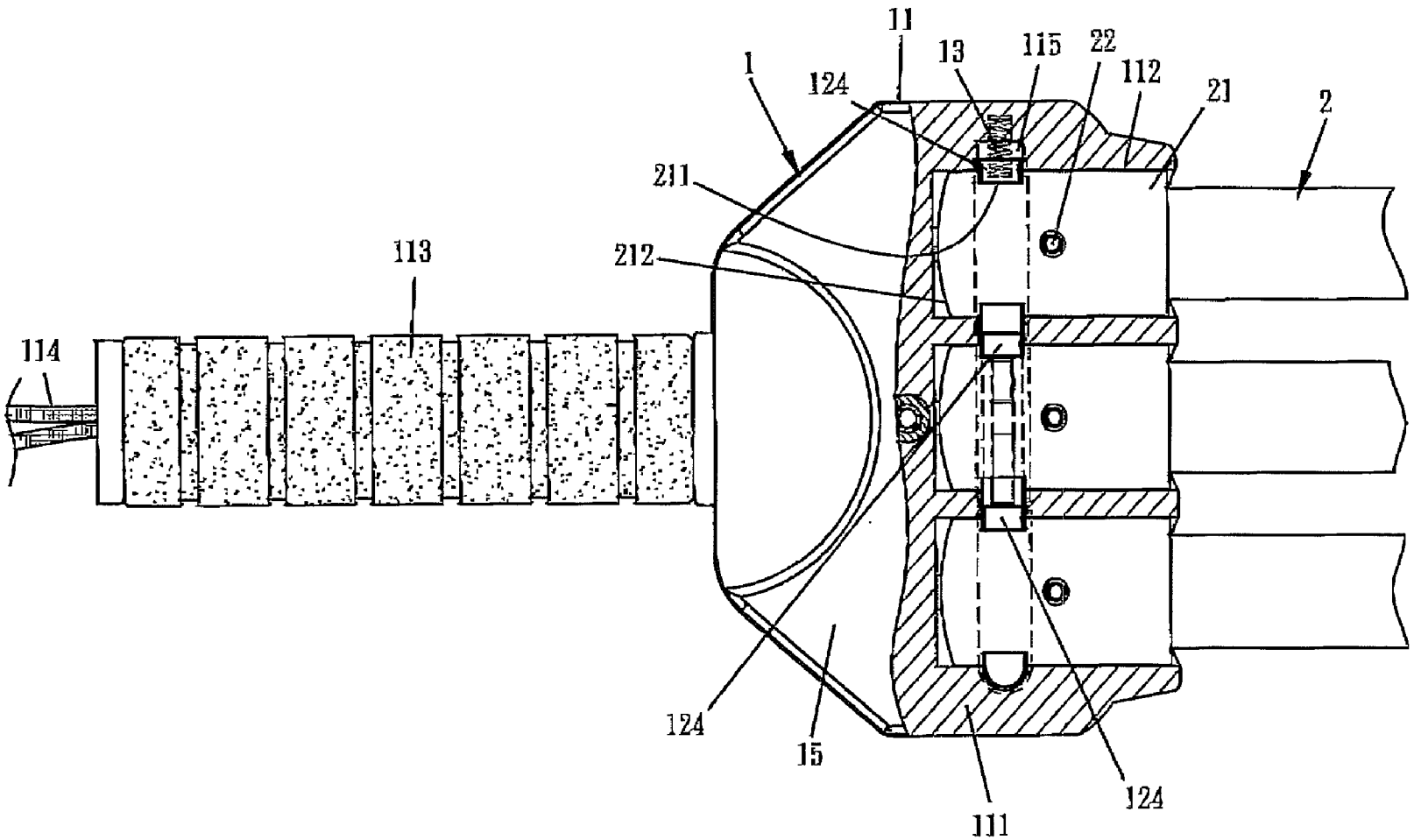
FIG. 4 is a top cross-sectional view of the twist exercising device as shown in FIG. 2.
Figure 5:
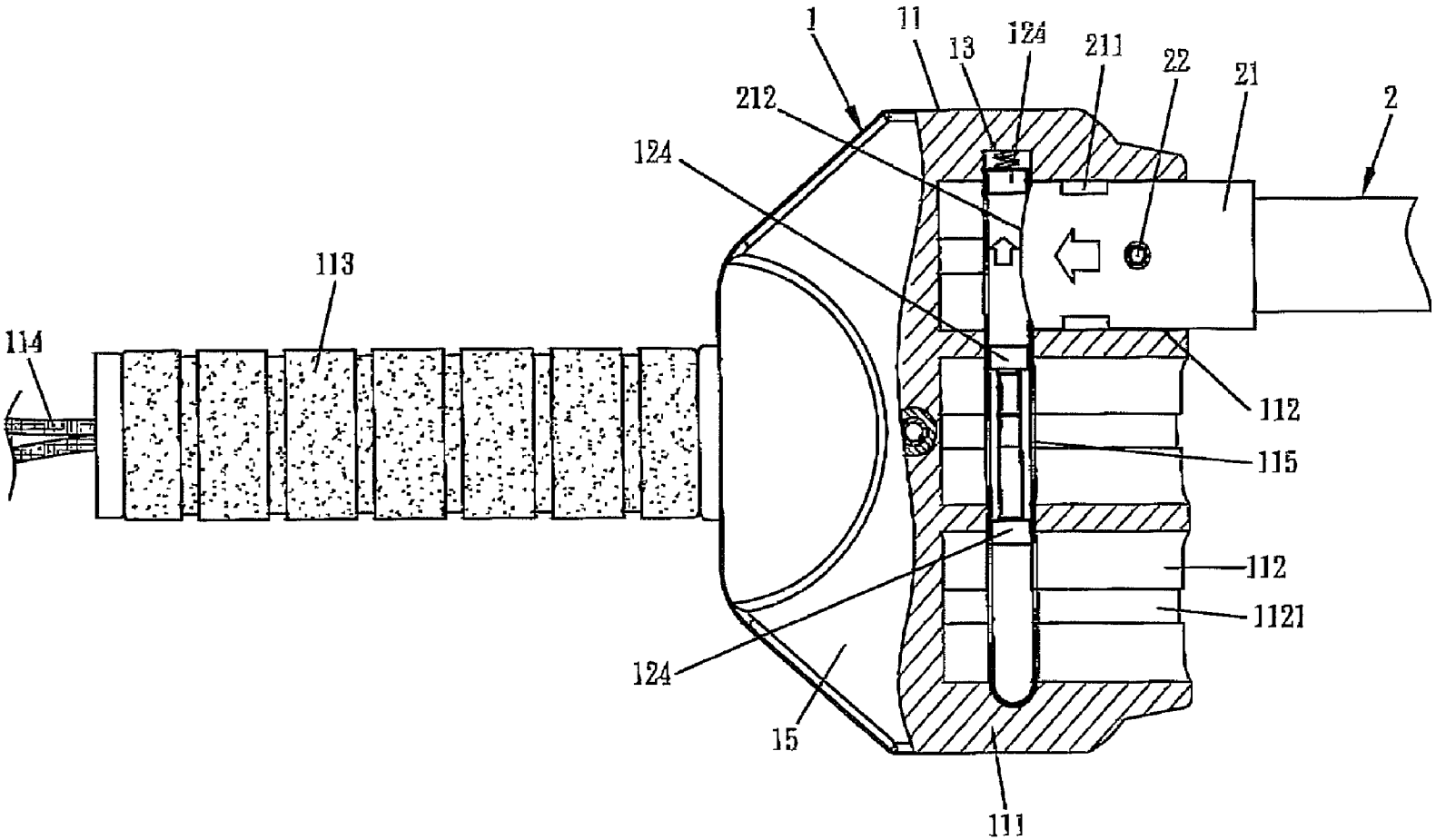
FIG. 5 is a schematic operational view of the twist exercising device as shown in FIG. 4.

In assembly of the twist exercising device, referring to FIGS. 4 and 5 with reference to FIGS. 1-3, when the plug 21 of each of the elastic bars 2 is inserted into the respective slot 112 of each of the two handle units 1, the push and guide portion 212 of the plug 21 of each of the elastic bars 2 presses and moves the respective locking block 124 of the locking member 12 of each of the two handle units 1 to compress the elastic member 13 as shown in FIG. 5. Then, when each of the locking blocks 124 of the locking member 12 aligns with the locking groove 211 of the respective plug 21 of each of the elastic bars 2, the elastic member 13 of each of the two handle units 1 presses and moves each of the locking blocks 124 of the locking member 12 toward the locking groove 211 of the respective plug 21 of each of the elastic bars 2, so that each of the locking blocks 124 of the locking member 12 is locked in the locking groove 211 of the respective plug 21 of each of the elastic bars 2 as shown in FIG. 4. Thus, the respective plug 21 of each of the elastic bars 2 is locked onto the housing 11 of each of the two handle units 1 so that each of the elastic bars 2 is mounted between the two handle units 1 as shown in FIG. 1.

When in use, after the user's two hands hold the grip portions 113 of the two handle units 1, the user can apply a force on the grip portions 113 of the two handle units 1 to twist and bend the elastic bars 2 so as to achieve an exercising effect to the user's two hands and chest.

Figure 6:
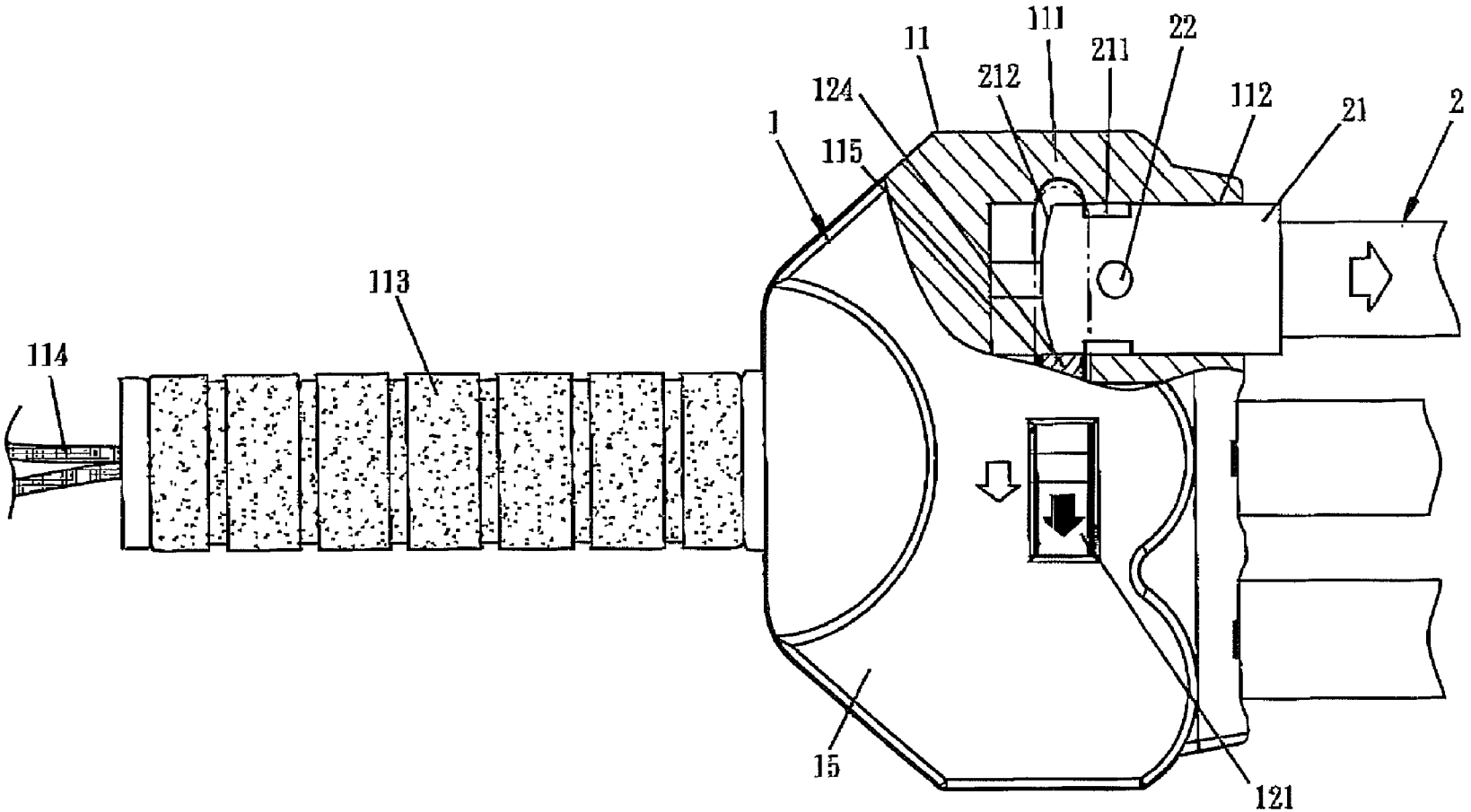
FIG. 6 is a schematic operational view of the twist exercising device as shown in FIG. 4.

In detachment of the twist exercising device, referring to FIG. 6 with reference to FIGS. 1-3, the drive portion 121 of the locking member 12 of each of the two handle units 1 is moved toward the elastic member 13 to compress the elastic member 13 and to move and detach each of the locking blocks 124 of the locking member 12 from the locking groove 211 of the respective plug 21 of each of the elastic bars 2, so that the respective plug 21 of each of the elastic bars 2 is unlocked from the housing 11 of each of the two handle units 1, and each of the elastic bars 2 can be detached from the two handle units 1 as shown in FIG. 6.

As shown in FIG. 1, three elastic bars 2 are mounted between the two handle units 1.

Figure 7:
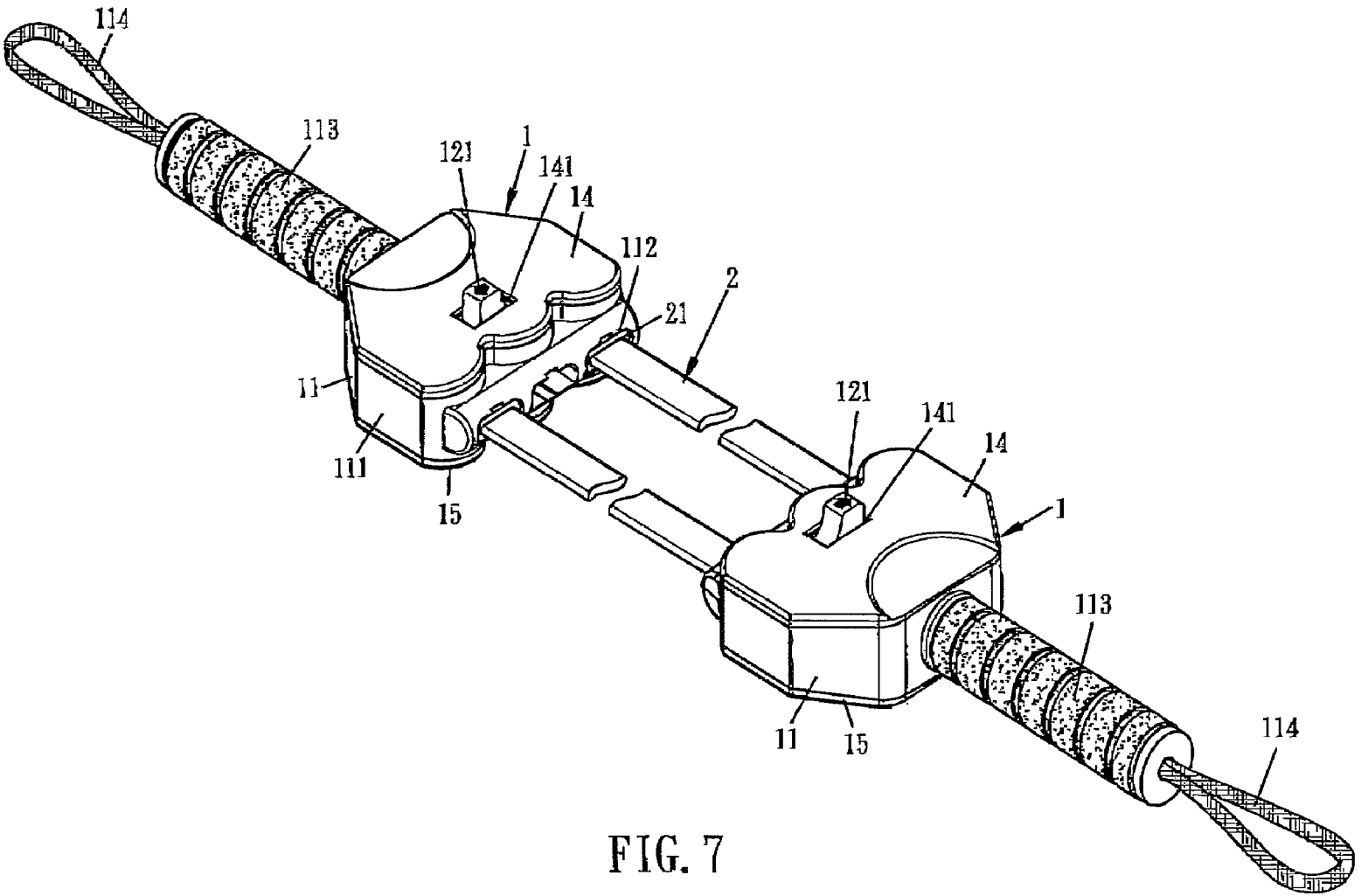
FIG. 7 is a perspective view of a twist exercising device in accordance with another preferred embodiment of the present invention.

As shown in FIG. 7, two elastic bars 2 are mounted between the two handle units 1.

Figure 8:
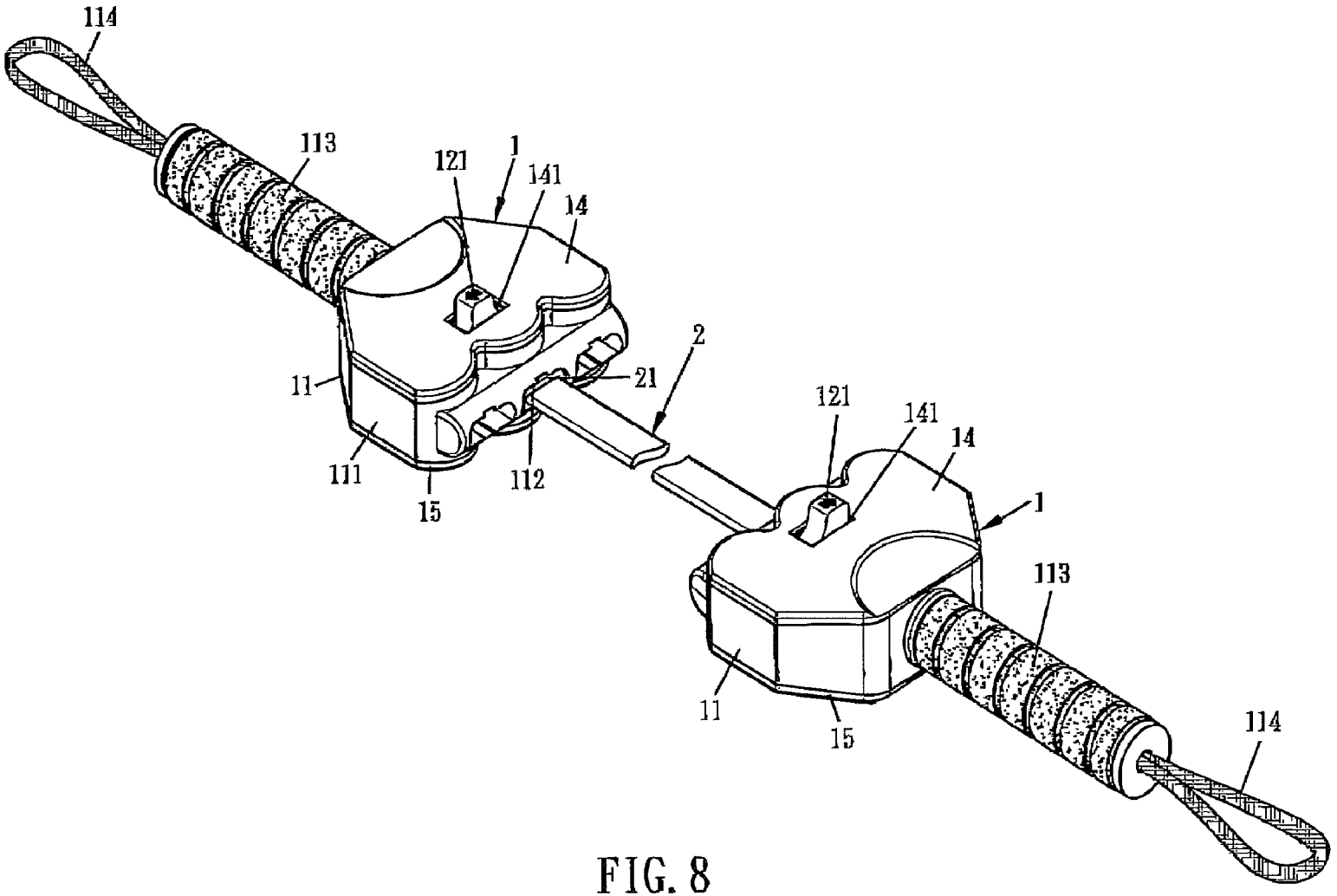
FIG. 8 is a perspective view of a twist exercising device in accordance with another preferred embodiment of the present invention.
Figure 9:
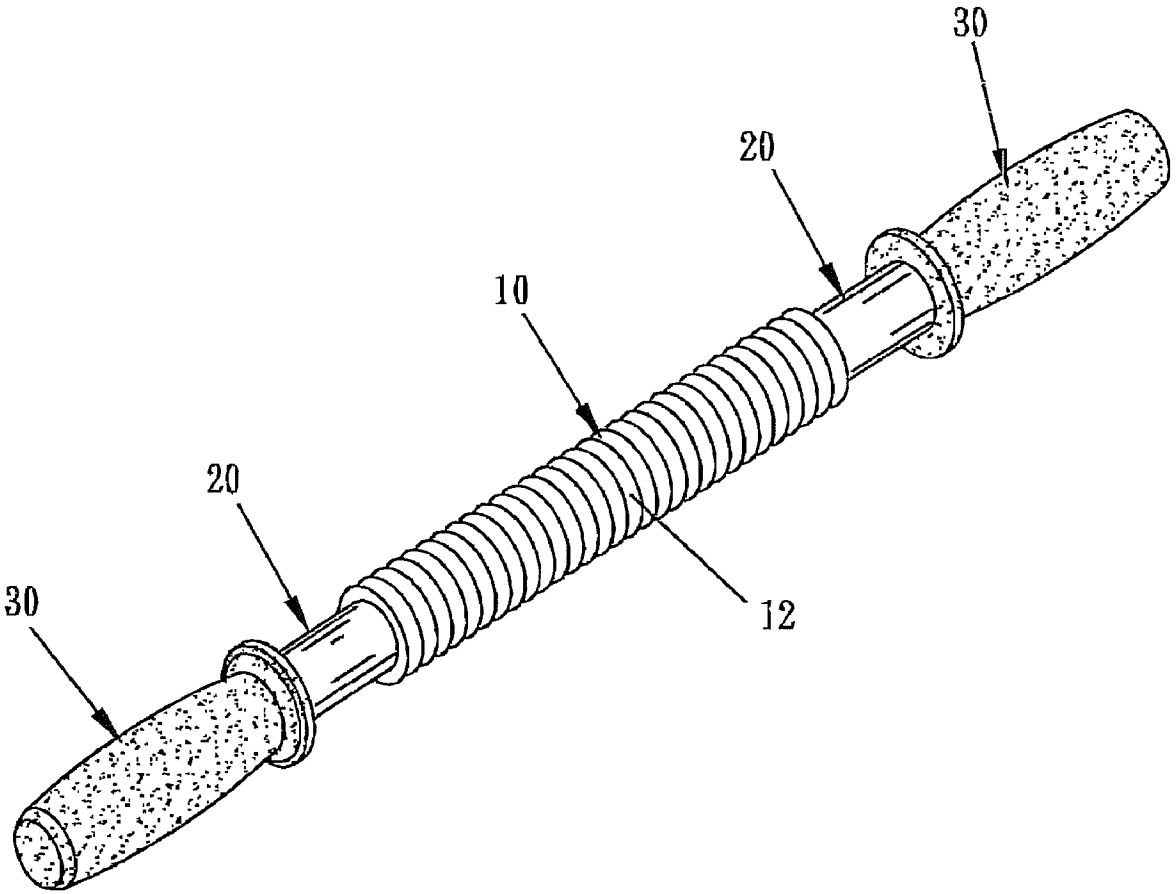
FIG. 9 PRIOR ART
FIG. 9 is a perspective view of a conventional twist bar in accordance with the prior art.

As shown in FIG. 8, only one elastic bar 2 is mounted between the two handle units 1.

Accordingly, the number of the elastic bars 2 mounted between the two handle units 1 can be changed freely so as to adjust the tension of the elastic bars 2 according to the user's requirement. In addition, the elastic bars 2 are mounted on and detached from each of the two handle units 1 easily and quickly, thereby facilitating the user assembling and disassembling the twist exercising device. Further, the elastic bars 2 are spaced from each other, and each of the elastic bars 2 is an elongate sheet plate so that the elastic bars 2 will not clip or jam the user during operation so as to protect the user's safety. Further, the elastic bars 2 can be detached from the two handle units 1 when not in use, thereby facilitating and decreasing the cost of packaging, storage and transportation of the twist exercising device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A twist exercising device, comprising:

two handle units (1);

a plurality of elastic bars (2) detachably mounted between the two handle units;

wherein each of the two handle units includes:

a housing (11) for mounting the elastic bars;

a locking member (12) movably mounted on the housing and releasably locked onto the elastic bars to releasably lock the elastic bars onto the housing;

the housing of each of the two handle units has an end face provided with a plurality of slots (112) to allow insertion of the elastic bars;

each of the elastic bars has two opposite ends each provided with a plug (21) insertable into a respective one of the slots of the housing of each of the two handle units and releasably locked by the locking member of each of the two handle units;

the locking member of each of the two handle units has a first side provided with a plurality of locking blocks (124) to releasably lock the elastic bars and a second side provided with a drive portion (121) protruding outwardly from the housing;

the plug of each of the elastic bars has a periphery provided with a locking groove (211) releasably locked onto a respective one of the locking blocks of the locking member of each of the two handle units.

2. The twist exercising device of claim 1, wherein the housing of each of the two handle units has an inner portion provided with an elongate slideway (115) connected to the slots to allow a sliding movement of the locking member;

the locking member of each of the two handle units is slidably mounted in the slideway.

3. The twist exercising device of claim 2, wherein the locking member of each of the two handle units is provided with a reduced sliding portion (122) slidable in the slideway;

each of the locking blocks extends outwardly from the sliding portion and extends into the slideway.

4. A twist exercising device, comprising:

two handle units (1);

a plurality of elastic bars (2) detachably mounted between the two handle units;

wherein each of the two handle units includes:

a housing (11) for mounting the elastic bars;

a locking member (12) movably mounted on the housing and releasably locked onto the elastic bars to releasably lock the elastic bars onto the housing;

the housing of each of the two handle units has an end face provided with a plurality of slots (112) to allow insertion of the elastic bars;

each of the elastic bars has two opposite ends each provided with a plug (21) insertable into a respective one of the slots of the housing of each of the two handle units and releasably locked by the locking member of each of the two handle units;

each of the slots of the housing of each of the two handle units has a periphery provided with two opposite passages (1121);

the plug of each of the elastic bars is secured on each of the elastic bars by a rivet (22) which is allowed to pass through the passages of the respective slot of each of the two handle units.

5. The twist exercising device of claim 2, wherein each of the two handle units further includes:

an elastic member (13) mounted in the housing and biased between the housing and the locking member;

a first cover (14) mounted on the housing to cover the locking member;

a second cover (15) mounted on the housing and combined with the first cover to sandwich the housing between the first cover and the second cover and to limit the locking member between the first cover and the second cover.

6. The twist exercising device of claim 5, wherein the housing of each of the two handle units has a sidewall (111) provided with a receiving groove (116) connected to the slideway to retain the elastic member;

the locking member of each of the two handle units has an end portion provided with a receiving hole (123) to receive the elastic member.

7. The twist exercising device of claim 5, wherein the first cover of each of the two handle units has a surface provided with an exposing slot (141);

the drive portion of the locking member of each of the two handle units protrudes outwardly from and is movable in the exposing slot of the first cover.

8. The twist exercising device of claim 5, wherein the plug of each of the elastic bars has an end face provided with a substantially arc-shaped push and guide portion (212) that is movable to abut the respective locking block of the locking member of each of the two handle units when the plug of each of the elastic bars is inserted into the respective slot of the housing of each of the two handle units.

9. The twist exercising device of claim 1, wherein each of the elastic bars is an elongate sheet plate.

10. The twist exercising device of claim 1, wherein each of the two handle units further includes:

a resilient grip portion mounted on the housing.

11. The twist exercising device of claim 10, wherein each of the two handle units further includes:

a binding loop mounted on the grip portion.

12. The twist exercising device of claim 5, wherein the drive portion of the locking member of each of the two handle units is movable toward the elastic member to compress the elastic member and to move and detach each of the locking blocks of the locking member from the locking groove of the respective plug of each of the elastic bars, so that the respective plug of each of the elastic bars is unlockable from the housing of each of the two handle units.

13. The twist exercising device of claim 5, wherein the elastic member of each of the two handle units is received in the slideway.

14. The twist exercising device of claim 6, wherein the elastic member of each of the two handle units has a first end received in the receiving hole of the locking member and a second end received in the receiving groove of the housing.

15. The twist exercising device of claim 1, wherein the elastic bars are spaced from each other.

16. The twist exercising device of claim 8, wherein the push and guide portion of the plug of each of the elastic bars presses and moves the respective locking block of the locking member of each of the two handle units to compress the elastic member of each of the two handle units.

17. The twist exercising device of claim 5, wherein the elastic member of each of the two handle units presses and moves each of the locking blocks of the locking member toward the locking groove of the respective plug of each of the elastic bars when each of the locking blocks of the locking member aligns with the locking groove of the respective plug of each of the elastic bars.

18. The twist exercising device of claim 1, wherein the locking member of each of the two handle units has an elongate shape.

19. The twist exercising device of claim 1, wherein each of the elastic bars has a substantially rectangular or circular cross-sectional profile.

* * * * *